US008038321B1

(12) United States Patent
Franck et al.

(10) Patent No.: US 8,038,321 B1
(45) Date of Patent: Oct. 18, 2011

(54) COLOR MIXING LUMINAIRE

(75) Inventors: Peter Franck, Seekonk, MA (US); Sherman Ng, South Dartmouth, MA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 516 days.

(21) Appl. No.: 12/115,857

(22) Filed: May 6, 2008

(51) Int. Cl.
*F21V 21/00* (2006.01)

(52) U.S. Cl. ..... 362/249.02; 362/322; 362/364

(58) Field of Classification Search ..... 362/146, 362/147, 153.1, 227, 230, 231, 232, 235, 362/236, 240, 241, 242, 243, 249.01, 249.02, 362/249.03, 249.07, 277, 279, 281–284, 362/319, 322, 327, 341, 342, 346, 347, 350, 362/352, 361, 364–366, 404, 405, 800
See application file for complete search history.

(56) References Cited

U.S. PATENT DOCUMENTS

| | | | | |
|---|---|---|---|---|
| 3,279,406 | A | 10/1966 | Ricketts | |
| 3,643,089 | A | 2/1972 | Marantz | |
| 4,623,956 | A | 11/1986 | Conti | |
| 4,796,169 | A | 1/1989 | Shemitz | |
| 4,831,506 | A * | 5/1989 | Miyazawa | 362/526 |
| 5,738,436 | A * | 4/1998 | Cummings et al. | 362/294 |
| 6,068,388 | A * | 5/2000 | Walker et al. | 362/304 |
| 6,149,283 | A * | 11/2000 | Conway et al. | 362/236 |
| 6,462,669 | B1 | 10/2002 | Pederson | |
| 6,464,377 | B2 * | 10/2002 | Splane, Jr. | 362/296.08 |
| 6,547,416 | B2 * | 4/2003 | Pashley et al. | 362/231 |
| 6,550,940 | B2 | 4/2003 | Kamiya | |
| 6,623,151 | B2 | 9/2003 | Pederson | |
| 6,634,763 | B1 | 10/2003 | Leifer | |
| 6,779,908 | B1 * | 8/2004 | Ng | 362/147 |
| 6,902,308 | B2 | 6/2005 | Love | |
| 6,994,456 | B1 | 2/2006 | Russo | |
| 7,064,674 | B2 | 6/2006 | Pederson | |
| 7,108,394 | B1 | 9/2006 | Swarens | |
| 7,204,607 | B2 | 4/2007 | Yano | |
| 7,217,009 | B2 | 5/2007 | Klose | |
| 7,246,926 | B2 | 7/2007 | Harwood | |
| 7,614,767 | B2 * | 11/2009 | Zulim et al. | 362/296.01 |
| 2005/0168987 | A1 | 8/2005 | Tamaoki | |
| 2005/0231948 | A1 | 10/2005 | Pohlert | |
| 2005/0237747 | A1 | 10/2005 | Shimizu | |
| 2005/0254241 | A1 | 11/2005 | Harwood | |
| 2006/0181862 | A1 | 8/2006 | Pohlert | |
| 2006/0203465 | A1 | 9/2006 | Chang | |
| 2006/0285341 | A1 | 12/2006 | Yatsuda | |
| 2007/0097700 | A1 | 5/2007 | Pederson | |
| 2007/0103894 | A1 | 5/2007 | Klose | |
| 2007/0115665 | A1 | 5/2007 | Mueller | |
| 2007/0195526 | A1 | 8/2007 | Dowling | |

* cited by examiner

*Primary Examiner* — Hargobind Sawhney

(57) ABSTRACT

A luminaire housing designed to be installed to illuminate an illumination area, wherein a light source is oriented within the housing to direct a central axis of emitted light rays away from the illumination area and towards a reflective surface of a stationary reflector. In some embodiments the stationary reflector is oriented and contoured to reflect the light rays towards a light spread lens having one end positioned above at least a portion of a reflector lip and angled into the housing with respect to a light passageway. Optionally, the luminaire housing may be a recessed luminaire housing.

17 Claims, 8 Drawing Sheets

COLOR MIXING LUMINAIRE

CROSS-REFERENCE TO RELATED APPLICATIONS

Not Applicable.

FIELD OF THE INVENTION

The present invention relates generally to a luminaire housing and, more particularly to a luminaire housing supporting at least one reflector for mixing color output.

DESCRIPTION OF THE RELATED ART

Various luminaires have been provided having luminaire housings which support a reflector and a light source. Some of these luminaire housings additionally contain a lens.

DETAILED DESCRIPTION OF THE PREFERRED EMBODIMENTS

Figure 1:
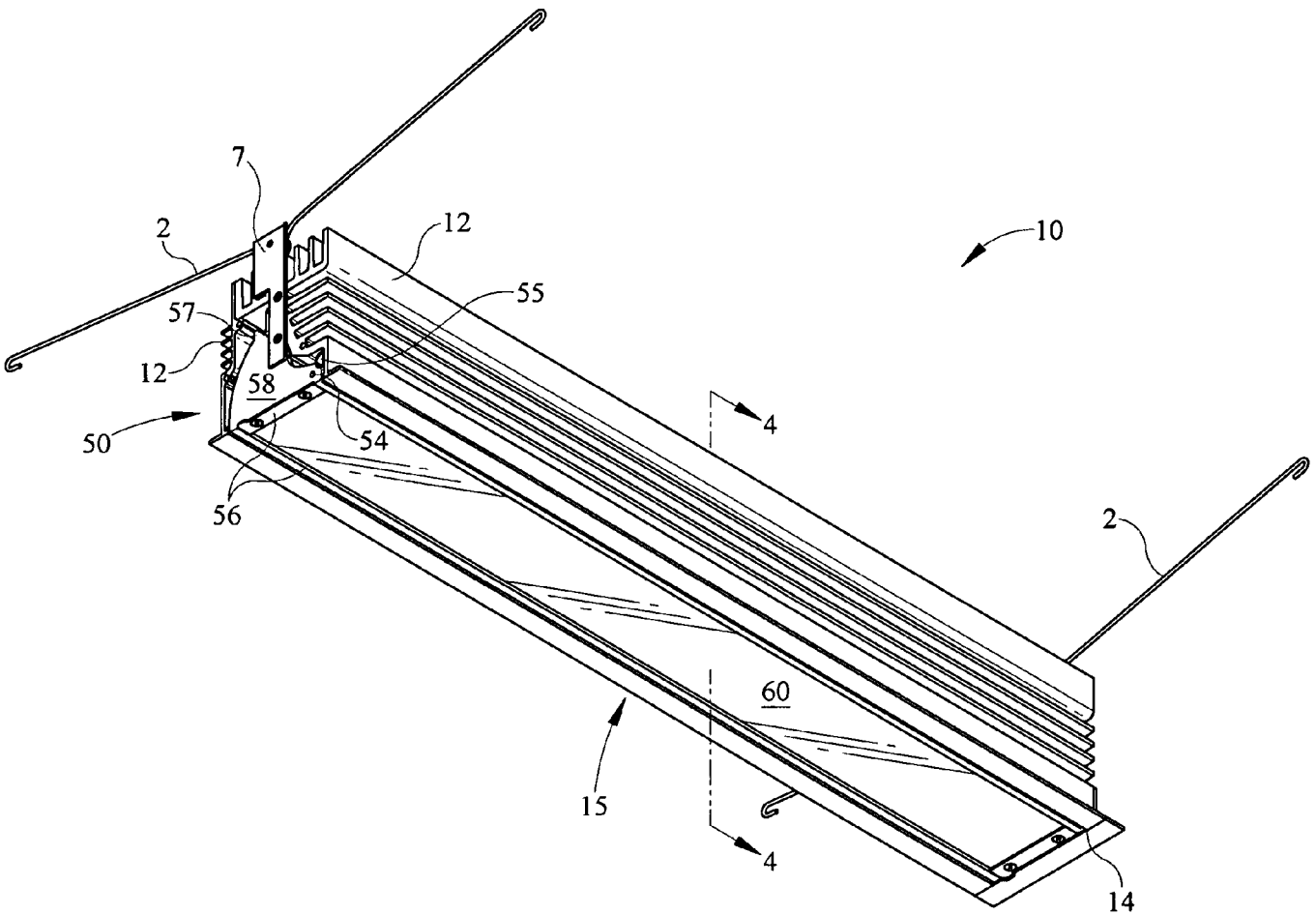
FIG. 1 is a bottom perspective view of a first embodiment of a luminaire housing shown with an end portion of the housing removed and an adjustable reflector supported by the housing in a first position.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof is meant to encompass the items listed thereafter and equivalents thereof as well as additional items. Unless limited otherwise, the terms "connected," "coupled," "in communication with" and "mounted," and variations thereof are used broadly and encompass direct and indirect connections, couplings, and mountings. In addition, the terms "attached," "connected," and "coupled" and variations thereof are not restricted to physical or mechanical attachments, connections, or couplings. Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-8 various aspects of a luminaire housing. FIG. 1 shows a first embodiment of a luminaire housing 10. Luminaire housing 10 is preferably provided with at least one heatsink 12 on the exterior to aide in dissipation of heat produced by constituent parts of luminaire housing 10 and particularly heat created by the color LEDs in the present embodiment. Any heatsink 12 may optionally be in direct contact with any such constituent parts. Luminaire housing 10 also has a light passageway perimeter or frame 14 that defines a light passageway 15. Light passageway perimeter 14 is shown having a flange portion extending outwardly therefrom for aesthetic purposes and potentially installation purposes, but flange portion is not necessary to define light passageway perimeter 14 or light passageway 15. A portion of adjustable color mixing LED reflector 50 is also shown in FIG. 1. Adjustable reflector 50 is provided with a light spread lens 60 attached to a base 56 of adjustable reflector 50 and is shown in a first position. Preferably, light spread lens 60 is a prismatic spread lens that spreads light rays incident upon it along more than one axis. However, the term "light spread lens" is used broadly and may encompass any number of lenses that provide for appropriate distribution of light rays.

The luminaire housing is designed to be installed to illuminate an illumination area. In some embodiments it comprises a housing supporting a light source, the light source in some embodiments being color LEDs, a stationary reflector, and an adjustable reflector, where the housing has a light passageway perimeter defining a light passageway and the reflectors are positioned to maximize color mixing from, for example, RGBA LEDs. The light source is oriented within the housing to direct a central axis of emitted light rays away from the illumination area and towards a reflective surface of the stationary reflector when the luminaire housing is installed. The reflective surface of the stationary reflector has a contour and orientation such that a majority of light rays emitted from the light source and striking the reflective surface are reflected toward the light passageway. The adjustable reflector has a base with a light spread lens attached thereto and a reflective surface with a similar contour and orientation as the reflective surface of the stationary reflector. The adjustable reflector is attached to the housing such that it is movable to at least a first and a second position. In the first position the reflective surface of the adjustable reflector is at least partially positioned between the light source and the stationary reflector and the light spread lens is substantially parallel with the light passageway. In the second position less of the reflective surface of the adjustable reflector is positioned between the light source and the stationary reflector than in the first position, and at least a portion of the reflective surface of the adjustable reflector is positioned below the light passageway perimeter and the light spread lens is disposed at an angle with respect to the light passageway perimeter.

In other embodiments the luminaire housing comprises a housing having a light passageway perimeter defining a light passageway and supporting a light source, a stationary reflector, an aperture reflector, and a light spread lens. The light source is oriented within the housing to direct a central axis of emitted light rays away from the illumination area and towards a reflective surface of the stationary reflector when the luminaire housing is installed. The light spread lens has a first end positioned above at least a portion of a reflector lip and a second end positioned internal to the housing such that the light spread lens is disposed at an angle with respect to the light passageway. A base of the reflector lip helps define a portion of the light passageway perimeter most distal the illumination area when the luminaire is installed. The aperture reflector has a first end positioned proximal to a portion of the light passageway substantially opposite the reflector lip and a second end positioned proximal to the light spread lens such that the aperture reflector is disposed at an angle with respect to the light passageway. The stationary reflector has a contour and orientation such that a majority of light rays emitted from the light source and striking the stationary reflector are reflected toward the light spread lens.

Figure 5:
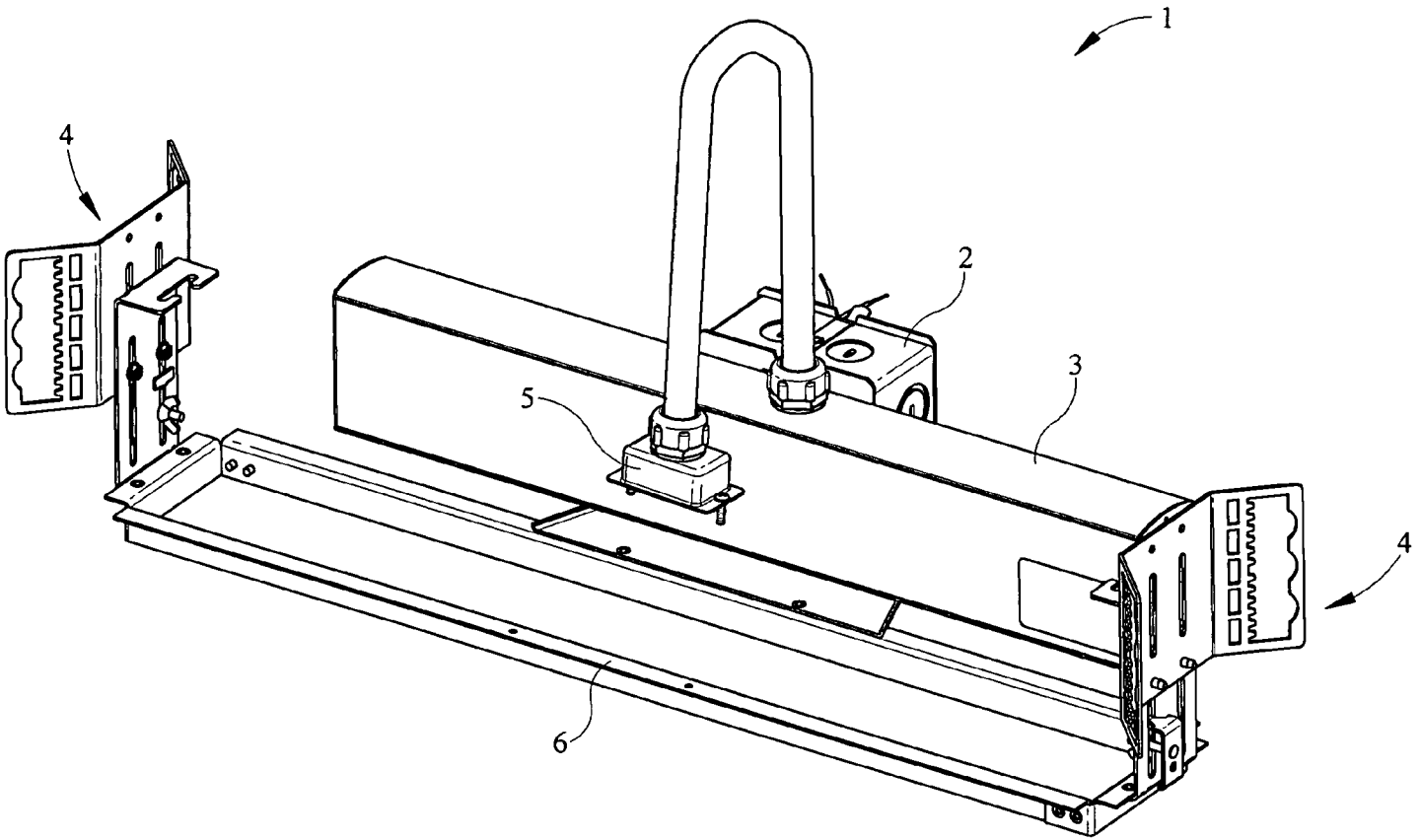
FIG. 5 is a top perspective view of a support for the luminaire housing of FIG. 1.

Returning to the various embodiments depicted, hanging supports 2 may be attachable to luminaire housing 10 in some embodiments for suspended installation of luminaire housing 10 from an object or surface. Of course cables, rigid supports, and the like may similarly be provided. Side support 7 may also be provided for installation purposes. Referring briefly to FIG. 5, luminaire housing 10 may likewise in some embodiments be installable in a recessed fashion by appropriately securing support 1 or other appropriate support into a ceiling or the like through attachment of joist supports 4 to a joist or other surface, or through the use of hanger bars (not shown). The flange portion extending outwardly from light passageway perimeter 14 may be placed in proximity to housing aperture 6 and luminaire housing 10 secured to support 1 by securing it with screws received in side support 7 or otherwise. Junction box 2 can be connected to incoming line voltage and optionally to a power supply 3 for alteration of incoming line voltage. A power connector 5 is also provided for connection to luminaire housing 10 to supply either line or altered voltage. Power connector 5, junction box 2, and optionally power supply 3, may also be provided separate from support 1 to provide luminaire housing with either line or altered voltage in other installation configurations.

Figure 2:
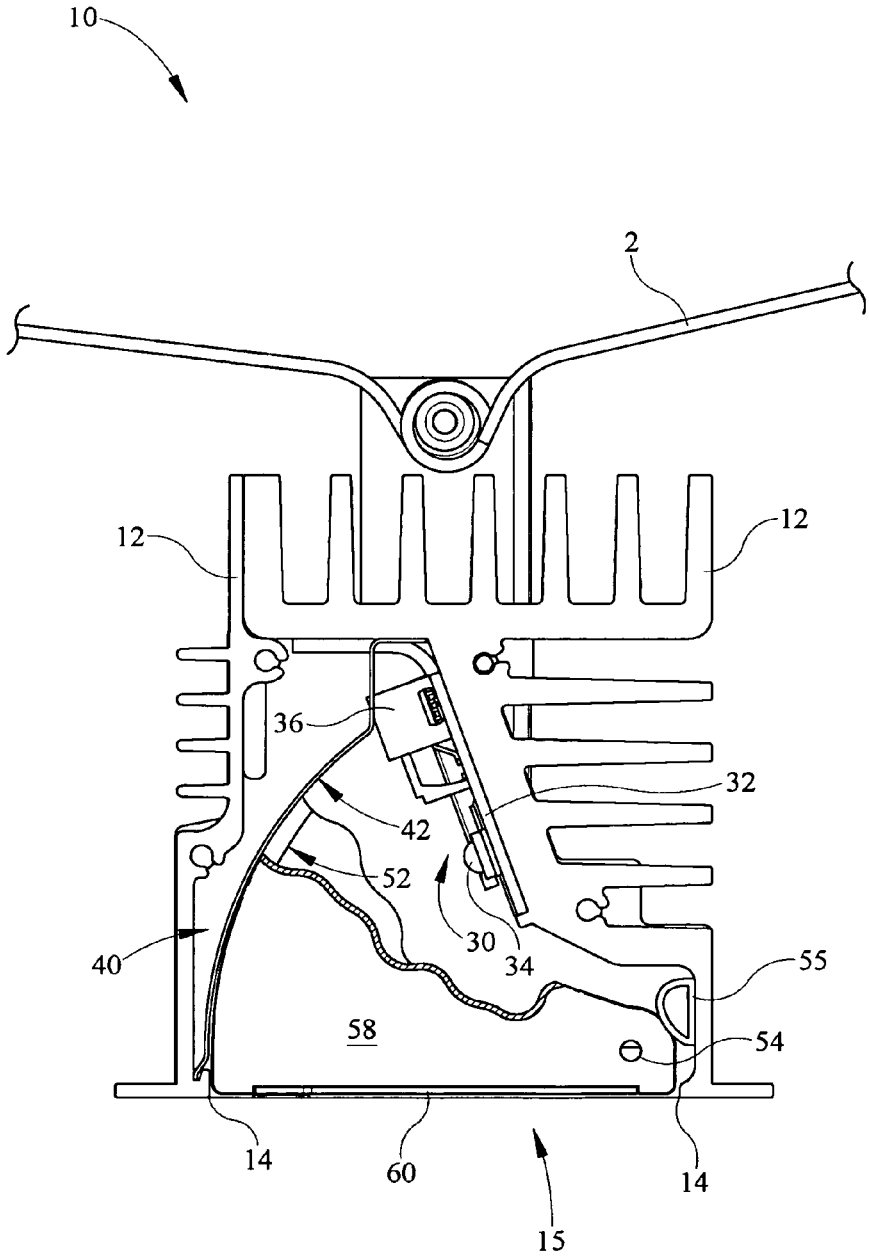
FIG. 2 is a side view of the luminaire housing of FIG. 1 with a side support removed and with portions of the adjustable reflector cut away.
Figure 3:
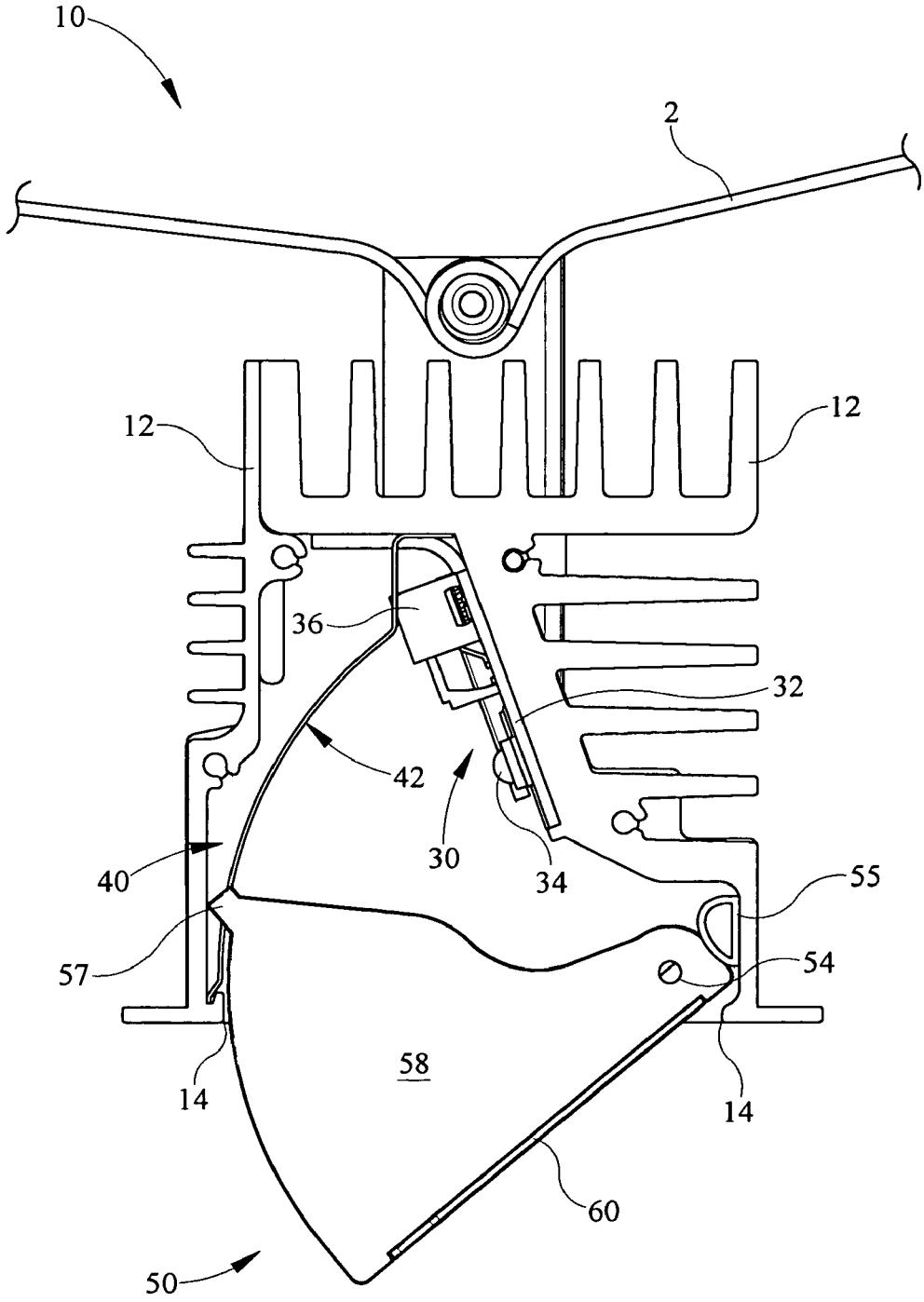
FIG. 3 is a side view of the luminaire housing of FIG. 1 with a side support removed and the adjustable reflector shown in a second position.
Figure 4:
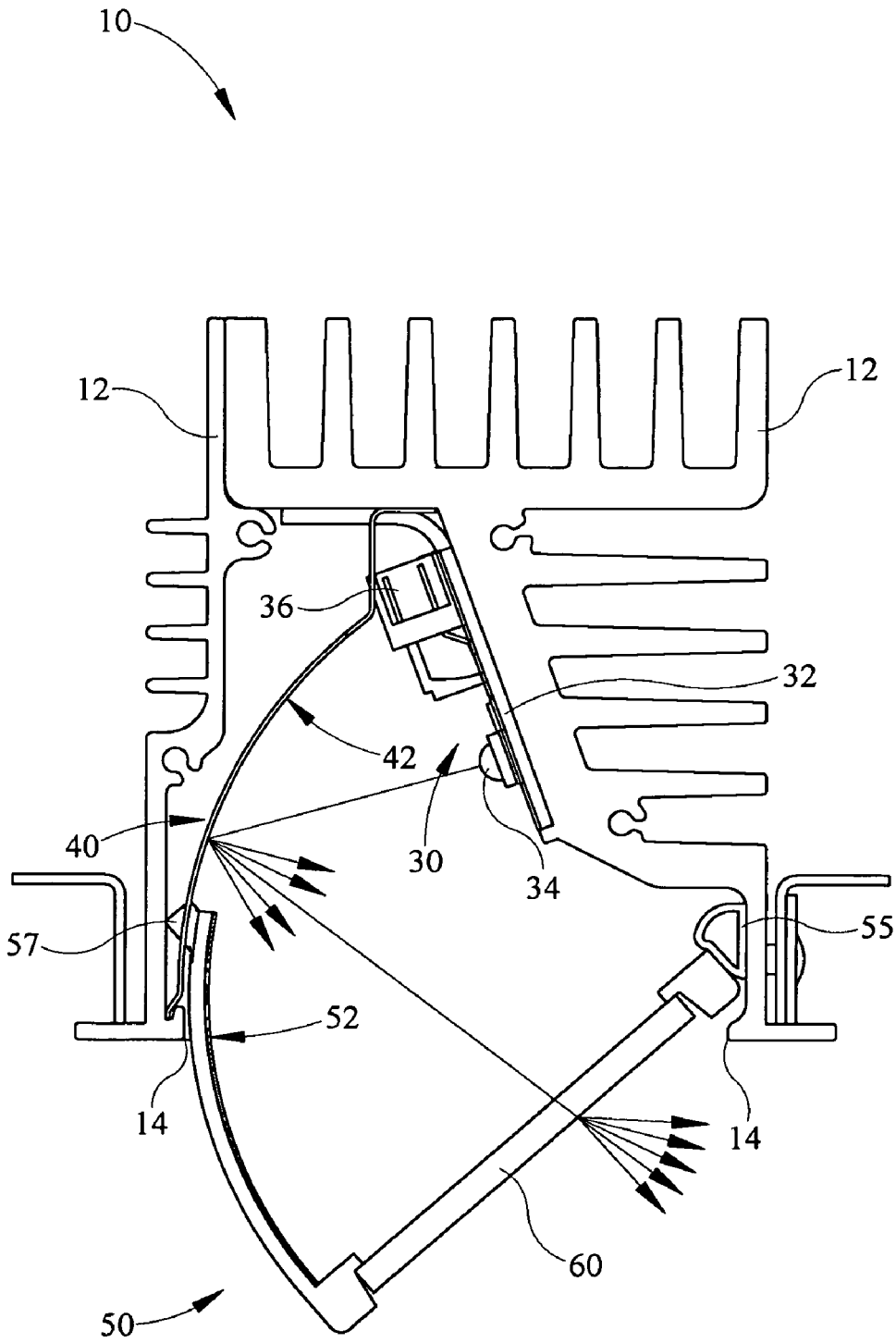
FIG. 4 is a side view of the luminaire housing of FIG. 1 taken along the line 4-4.

FIG. 2, FIG. 3 and FIG. 4 show internal portions of luminaire housing 10. A light source 30 is provided that preferably, and in this embodiment, consists of a plurality of LEDs 34 mounted on an LED board 32 and optionally a plurality of color LEDs such as in an RGBA configuration. In the embodiments of FIG. 2, FIG. 3, and FIG. 4, plurality of color or monochrome LEDs 34 are placed side by side in a row that runs nearly the entire length of luminaire housing 10, although they could be multi-tiered, scattered, or otherwise placed. An input 36 provides power from power connector 5 to LED board 32 to enable LED board to power plurality of LEDs 34. When emitting light rays, light source 30 directs a central axis of those light rays, generally indicated by the main arrow of FIG. 4, towards a reflective surface 42 of a stationary reflector 40. The arrows emanating from the main arrow of FIG. 4 indicate the mixing of rays caused by reflective surface 42 and light spread lens 60. When luminaire housing 10 is installed, this central axis of light rays is also directed away from the area which will be illuminated by luminaire housing 10. To direct a central axis of light rays toward a reflective surface 42 of stationary reflector 40 does not require that light source 30 be unidirectional, rather, it simply requires that a central axis of those rays which light source 30 does emit, are directed towards a reflective surface 42 of stationary reflector 40. For example, not all light rays emitted from plurality of LEDs 34 will follow the path indicated by the arrow of FIG. 4. Rather, the arrow merely indicates the central axis of rays that will be directed from LEDS 34 and toward reflective surface 42 of stationary reflector 42 both above and below the point generally indicated by the arrow of FIG. 4. Thus, plurality of LEDs 34 may be of the side-emitting type, Lambert type, or any other type.

In some embodiments, plurality of LEDs 34 are multicolored, that is, some LEDs emit light in one visible spectrum while other LEDs emit light in other visible spectrums. The plurality of LEDs 34 are provided that emit light on visible green, red, and blue spectrums. Preferably, LED board 32 may also selectively power individual LEDs out of plurality of LEDs 34. For example, LED board 32 may selectively power only LEDs emitting light on the same visible spectrum or LED board 32 may power LEDs emitting light on multiple visible spectrums without powering the entirety of plurality of LEDs. Such functionality enables light of various wavelengths and brightness to be emitted. In some embodiments, input 36 also provides an electrical signal to LED board that directs which LEDS of plurality of LEDs 34 that LED board 32 should power. This logic may be communicated from a multitude of sources, such as a preset programmed device, a user, or from other luminaires.

Stationary reflector 40 is best shown in FIG. 3 and preferably runs nearly the entire length of the internal portion of luminaire housing 10 and is supported by luminaire housing 10. In the embodiment of FIG. 2 and FIG. 3 stationary reflector 40 is supported at one end through insertion in a notch in luminaire housing 10 proximal to a portion of light passageway perimeter 14 and at the other end through attachment to a surface of luminaire housing 10 above light source 30. However, in other embodiments other forms and locations of attachment may be provided. Stationary reflector 40 has a contoured portion that directs a majority of any light rays incident upon it generally towards light passageway 15. Reflective surface 42 is provided at least on this contoured portion of stationary reflector 40 that generally faces light source 30. Reflective surface 42 is preferably generally smooth although in some embodiments reflective surface 42 may be faceted or otherwise textured.

An adjustable reflector 50 is also provided and also preferably runs nearly the entire length of the internal portion of luminaire housing 10 and is supported by luminaire housing 10. Adjustable reflector 50 also has a contoured portion with a reflective surface 52. The contoured portion of adjustable reflector 50 is preferably similar to the contoured portion of stationary reflector 40, such that all or any portion of the contoured portion of adjustable reflector 50 may sit between stationary reflector 40 and light source 30 and that portion of reflective surface 52 will direct a majority of any reflected light rays generally towards light passageway 15. Adjustable reflector 50 is also preferably provided with a sidewall 58 on each end whose exterior surface is preferably opaque to prevent light from passing therethrough when adjustable reflector 50 is in the down position. Sidewall 58 may optionally be provided with a reflective interior surface. Adjustable reflector 50 is also provided with a base 56 for securing light spread lens 60. Base 56 of adjustable reflector 50 is shown having a flange portion that secures light spread lens 60, although light spread lens 60 could be secured to base 56 of luminaire housing without provision of the flange portion. In embodiments having a flange portion, the flange portion exterior is preferably opaque to prevent light from passing therethrough and the flange portion may optionally be provided with a reflective interior surface. Adjustable reflector 50 also has an opening generally opposite base 56 and light spread lens 60 that allows light from light source 30 to reach reflective surface 52. Preferably this opening is over the entire top portion of adjustable reflector 50, so as to not restrict the light that may reach reflective surface 52.

Adjustable reflector 50 is adjustable to at least a first and a second position. An exemplary embodiment of a first position is depicted in FIG. 2, wherein reflective surface 52 is positioned in between the majority of reflective surface 42 of stationary reflector 40 and light source 30. In this first position, a majority of light rays from light source 30 are reflected off reflective surface 52 and optionally portions of reflective surface 42, providing for mixing of the rays and directing the rays toward the light passageway 15. Most of those reflected rays will be incident upon light spread lens 60 and transmit and blend evenly through light spread lens 60 toward the illumination surface. If base 56 is provided with a reflective interior flange portion, rays incident upon it will be further reflected within luminaire housing 10 and will also eventually be incident upon light spread lens 60 and transmit and blend evenly through light spread lens 60 toward the illumination surface. Other light rays from light source 30 will not be internally reflected within luminaire housing 10, but will be immediately incident upon light spread lens 60 and transmit and blend evenly through light spread lens 60 toward the illumination surface. Reflective surfaces 52 and 42 and light spread lens 60 ensure that appropriately mixed and uniform rays will be incident upon the illumination surface.

An exemplary embodiment of a second position of adjustable reflector 50 is depicted in FIG. 3 and FIG. 4, wherein less of reflective surface 52 is positioned in between reflective surface 42 of stationary reflector 40 and light source 30. Moreover, in this second position a portion of reflective surface 52 of adjustable reflector 50 is positioned below light passageway 15 and light spread lens 60 is disposed at an angle with respect to light passageway 15. In this second position, a majority of light rays from light source 30 are reflected off reflective surfaces 52 and 42, thus providing for mixing of the light rays. The majority of light rays incident on reflective surfaces 52 or 42 above light passageway 15 are directed towards light passageway 15 and those incident on reflective surface 52 below light passageway 15 are generally directed towards light spread lens 60. Also, in this second position, some light rays that are reflected off reflective surface 42 are additionally reflected off reflective surface 52, and vice versa, thus providing for further mixing of the light rays. Most of these singularly and multiply reflected rays will be incident upon light spread lens 60 and transmit and blend evenly through light spread lens 60 toward the illumination surface. If base 56 is provided with a reflective interior flange portion, rays incident upon it will be further reflected within luminaire housing 10 and will also eventually be incident upon light spread lens 60 and transmit and blend evenly through light spread lens 60 toward the illumination surface. Other light rays from light source 30 may not be internally reflected within luminaire housing 10, but will be immediately incident upon light spread lens 60 and transmit and blend evenly through light spread lens 60 toward the illumination surface.

Reflective surfaces 52 and 42 and light spread lens 60 ensure that appropriately mixed and uniform rays will be incident upon the illumination surface. Thus, in embodiments of luminaire housing 10 that contain a plurality of multicolored LEDs 34, an appropriately color mixed and more visually appealing white light can be achieved. It will be appreciated by those skilled in the art that adjustable reflector 50 position of FIG. 3 will result in a larger area of light coverage on the illumination surface than adjustable reflector 50 position of FIG. 2. It will also be appreciated that adjustable reflector 50 may be adjustable to a number of positions between the described first and second positions to provide for varying amounts of light coverage, such as to provide downlight or to provide a wall wash effect if the lens is pulled forward as shown in FIG. 4. In the embodiment of FIG. 2 and FIG. 3 adjustable reflector 50 moves about a hinge element 54 and friction at hinge element 54 holds adjustable reflector 50 in a plurality of positions from the first to second position. A portion of adjustable reflector 50 near hinge element 54 also preferably interacts with a gasket 55 to prevent light from inadvertently exiting luminaire housing 10 near gasket 55. Appropriate force from a user upon adjustable reflector 50 will overcome the frictional hold and allow for adjustment of adjustable reflector 50 to a plurality of positions. A stop 57 is also provided in this embodiment on each end of adjustable reflector 50 that frictionally engages luminaire housing 10 to limit the range of motion of adjustable reflector 50. In some embodiments a hinge element 54 is provided that is a biased spring hinge and a member attached to housing 10 near light passageway perimeter 14 can be inserted into notches on the backside of reflective surface 52, or below the base of reflective surface 52, in order to stop reflective surface 52 in a plurality of positions. These are merely exemplary of the multitude of manners in which adjustable reflector 50 may be adjusted to a plurality of positions.

Figure 6:
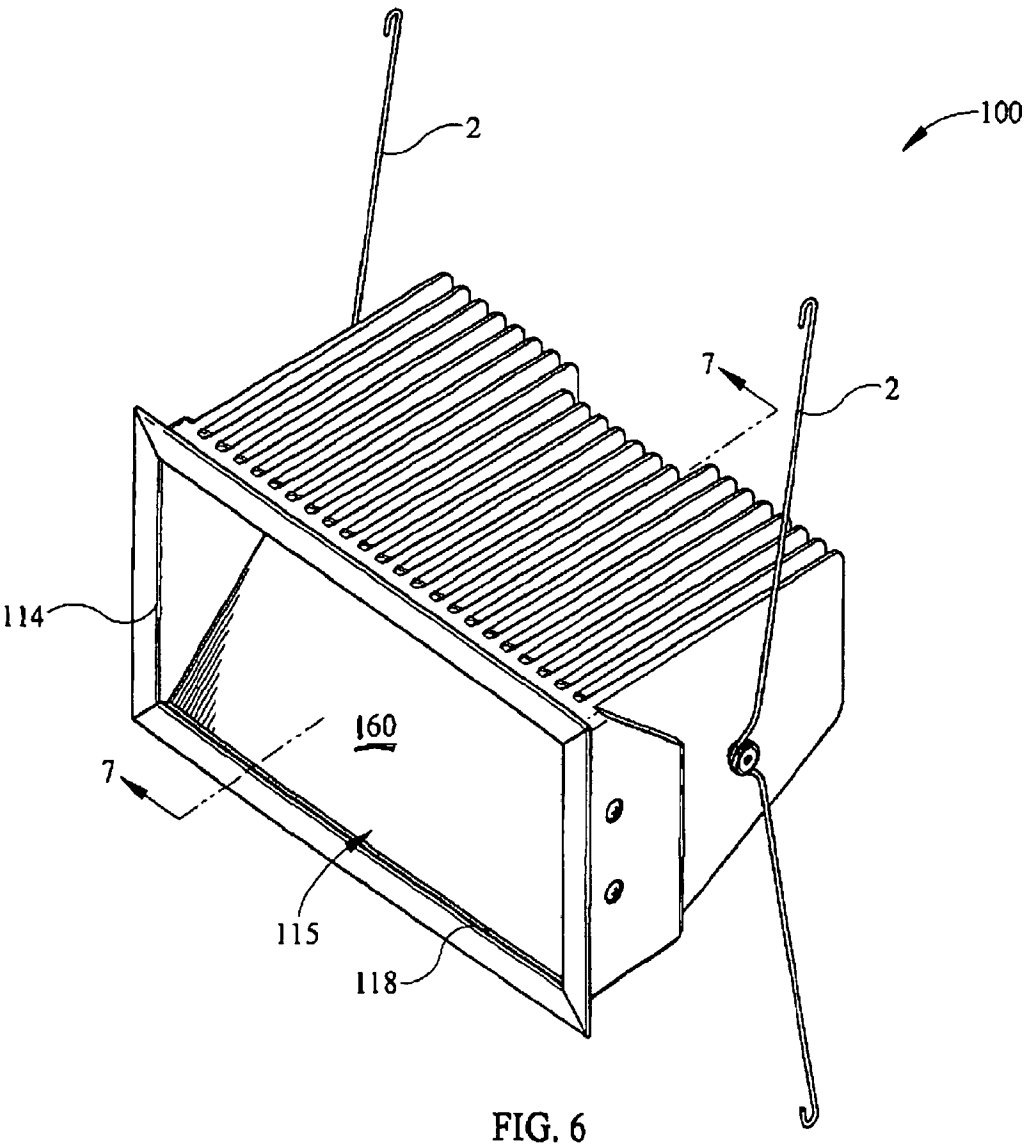
FIG. 6 is a perspective view of a second embodiment of a luminaire housing.
Figure 7:
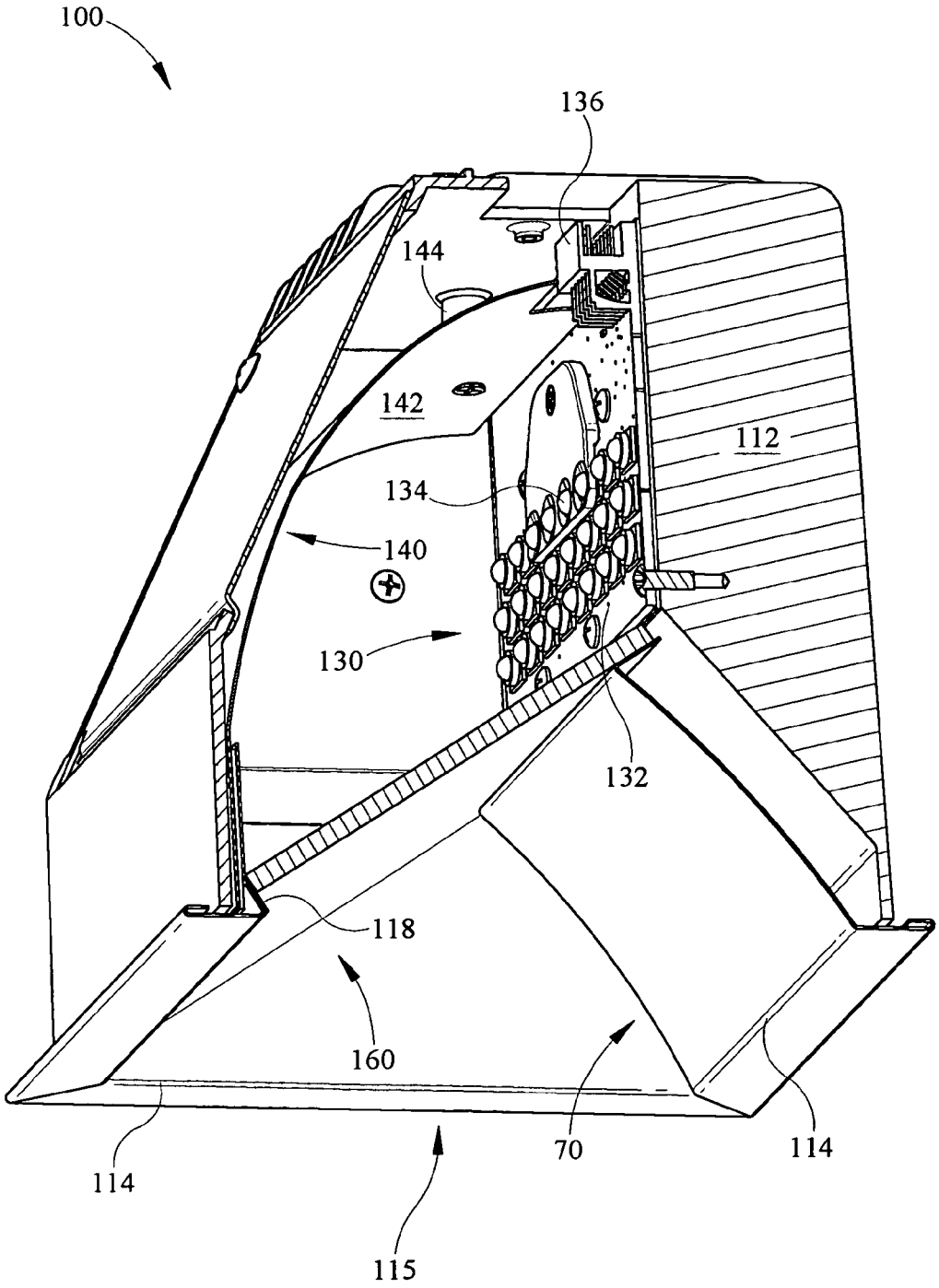
FIG. 7 is a side perspective view of the luminaire housing of FIG. 5 taken along the line 7-7.
Figure 8:
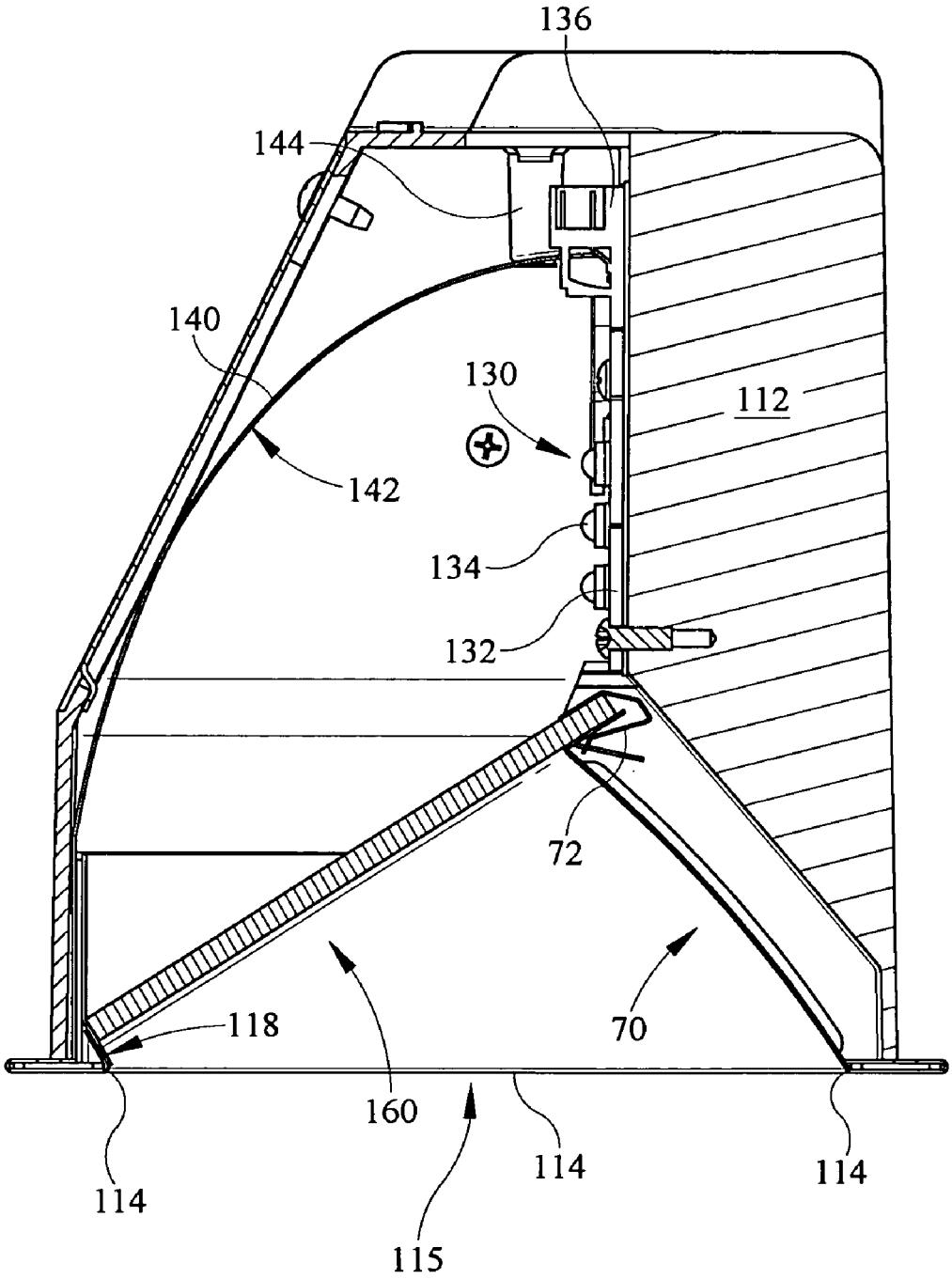
FIG. 8 is a side view of the luminaire housing of FIG. 5 taken along the line 7-7.

Referring now to FIG. 6-FIG. 8, a second embodiment of a luminaire housing 100 is provided. Turning to FIG. 6, luminaire housing 100 is preferably provided with at least one heatsink 112 on the exterior to aide in dissipation of heat produced by constituent parts internal to luminaire housing 100. Heatsink 112 may also be in direct contact with any such constituent parts. Luminaire housing 100 also has a light passageway perimeter 114 that defines light passageway 115. Light passageway perimeter 114 is shown having a flange portion extending outwardly therefrom for aesthetic purposes and potentially installation purposes, but flange portion is not necessary to define light passageway perimeter 114 or light passageway 115. A portion of a light spread lens 160 and a reflector lip 118 are also shown in FIG. 6. As can be seen, a portion of reflector lip 118 defines a portion of light passageway perimeter 114. Luminaire housing 100 may be installable in the same manner as luminaire housing 10 using hanging supports 2 or other supports. Likewise, luminaire housing 100 in some embodiments may be installable in a recessed fashion in a similar manner as luminaire housing 100 using a support akin to the support of FIG. 5 or other appropriate support. Moreover, luminaire housing 100 may be powered similarly to luminaire housing 10.

FIG. 7 and FIG. 8 show internal portions of luminaire housing 100. A light source 130 is provided that preferably, and in this embodiment, consists of a plurality of LEDs 134 mounted on an LED board 132. In the embodiment of FIG. 7 and FIG. 8, plurality of LEDs 134 are placed in a three by eight grid, although they could all be side by side, scattered, or otherwise placed. An input 136 provides power to LED board 132 to enable LED board 132 to power plurality of LEDs 134. When emitting light rays, light source 130 directs a central axis of those rays towards a reflective surface 142 of a stationary reflector 140. When luminaire housing 100 is installed, this central axis of rays is also directed generally away from the area which will be illuminated by luminaire housing 100.

In some embodiments, plurality of LEDs 134 are multicolored. Preferably, plurality of LEDs 134 are provided that emit light on visible green, red, and blue spectrums and LED board 132 selectively powers individual LEDs out of plurality of LEDs 134. In some embodiments, input 136 also provides logic to LED board that directs which LEDS of plurality of LEDs 134 that LED board 132 should power.

Stationary reflector 140 preferably runs from proximal light spread lens 160 to proximal LED board 132 and is supported by luminaire housing 100. In the embodiment of FIG. 6, FIG. 7, and FIG. 8 stationary reflector 140 is supported at one end through insertion in a notch in luminaire housing 100 proximal to light spread lens 160 and at the other end through attachment to a support bar 144 of luminaire housing 100. However, in other embodiments other forms and locations of attachment may be provided. Stationary reflector 140 has a contoured portion that directs a majority of any reflected light rays produced by light source 130 generally towards light spread lens 160. Reflective surface 142 is provided at least on the contoured portion of stationary reflector that generally faces light source 130. Reflective surface 142 is preferably generally smooth although in some embodiments reflective surface 142 may be faceted or otherwise textured.

As best seen in FIG. 7 and FIG. 8, a base portion of reflector lip 118 defines a portion of light passageway perimeter 114. Another portion of light passageway perimeter 114 is preferably formed by one end of aperture reflector 70. Aperture reflector 70 is preferably contoured and extends at an angle from and is connected to a portion of light passageway perimeter 114 that will be most proximal the illumination surface when luminaire housing 100 is installed. Aperture reflector 70 preferably extends to a point where it is in contact with or in close proximity to light spread lens 160 and may optionally provide support for light spread lens 160. In some embodiments aperture reflector 70 is attached to light spread lens 160 with a clip 72. The side of aperture reflector 70 that does not generally face light passageway 115 prevents light rays incident on it from escaping luminaire housing 100. The opposite side of aperture reflector 70, which generally faces light passageway 115 is preferably reflective and contoured so as to reflect any light incident upon that side in a generally downward direction. Preferably, aperture reflector 70 is positioned and contoured so as to prevent a user from typically directly viewing light spread lens 160 or from experiencing the glare potentially associated with light spread lens 160. Alternatively, the side of aperture reflector 70 which generally faces light passageway may be non-reflective.

Light spread lens 160 is disposed at an angle with respect to light passageway 115 and extends from a point proximal to light source 130 and aperture reflector 70 to a point above at least a portion of reflector lip 118. Reflector lip 118 is connected to and helps form a portion of light passageway perimeter 114 that will be most distant the illumination surface when luminaire housing 100 is installed. Reflector lip 118 is positioned and designed such that light passing through light spread lens 160 and incident upon it will be reflected towards a top surface of the illumination surface when luminaire housing 100 is installed. In other words, it will direct light rays towards an area of the illumination surface proximal to and just below the plane in which light passageway 115 lies.

When luminaire housing 100 is installed, powered, and in use, a majority of light rays from light source 130 are reflected off reflective surface 142, thus providing for mixing of the light rays and directing the rays toward light spread lens 160. Most of those reflected rays will be incident upon light spread lens 160 and transmit and blend evenly through light spread lens 160 toward the illumination surface, or towards reflector lip 118 and then toward the top of the illumination surface. Other light rays will be further reflected within luminaire housing 100 and potentially blocked by aperture reflector 70 and will also eventually be incident upon light spread lens 160 and transmit and blend evenly through light spread lens 160 toward the illumination surface, or towards reflector lip 118 and then toward the top of the illumination surface. Other light rays from light source will not be reflected within luminaire housing 100, but will be immediately incident upon light spread lens 160 and transmit and blend evenly through light spread lens 160 toward the illumination surface or reflector lip 118 and then toward the top of the illumination surface.

The foregoing description of structures and methods has been presented for purposes of illustration. It is clear to one in the art that the foregoing description of luminaire housings are readily adaptable to round or square luminaire housings or luminaire housings of any profile. It is not intended to be exhaustive or to limit the invention to the precise steps and/or forms disclosed, and obviously many modifications and variations are possible in light of the above teaching. It is understood that while certain forms of a luminaire housing have been illustrated and described, it is not limited thereto except insofar as such limitations are included in the following claims and allowable functional equivalents thereof.

What is claimed is:

1. A luminaire housing designed to be installed to illuminate an illumination area, comprising:

a housing supporting a light source, a stationary reflector, an aperture reflector, and a light spread lens, said housing having a light passageway perimeter defining a light passageway;

a reflector lip being connected to said light passageway perimeter;

said light source being oriented within said housing to direct a central axis of emitted light rays away from the illumination area and towards a reflective surface of said stationary reflector when said luminaire housing is installed;

said light spread lens having a first end positioned above at least a portion of said reflector lip and a second end positioned internal to said housing such that said light spread lens is disposed at an angle with respect to said light passageway, wherein a base of said reflector lip helps define a portion of said light passageway perimeter most distal the illumination area when said luminaire is installed;

said aperture reflector having a first end positioned proximal to a portion of said light passageway substantially opposite said reflector lip and a second end positioned proximal to said light spread lens such that said aperture reflector is disposed at an angle with respect to said light passageway, said stationary reflector having a contour and orientation such that a majority of light rays emitted from said light source and striking said stationary reflector are reflected toward said light spread lens.

2. The luminaire housing of claim 1 wherein said second end of said aperture reflector is attached to said light spread lens proximal to said second end of said light spread lens.

3. The luminaire housing of claim 2 wherein a clip attaches said second end of said aperture reflector to said light spread lens proximal to said second end of said light spread lens.

4. The luminaire housing of claim 2 wherein said second end of said light spread lens is positioned proximal to, but below said light source.

5. The luminaire housing of claim 1 wherein said first end of said light spread lens is positioned above the entirety of said reflector lip.

6. The luminaire housing of claim 1 wherein said light source comprises at least one LED.

7. The luminaire housing of claim 1 wherein said light source comprises a plurality of multicolored LEDs.

8. The luminaire housing of claim 7 wherein said multicolor LEDs emit light in the red, blue, and green visible spectrums.

9. A luminaire housing designed to be installed into a first surface and illuminate an illumination area substantially perpendicular to the first surface, the luminaire housing comprising:

a housing supporting a light source, a stationary reflector, an aperture reflector, and a light spread lens, said housing having a light passageway perimeter defining a light passageway;

a reflector lip being connected to said light passageway perimeter;

said light source being oriented within said housing to direct a central axis of emitted light rays away from the illumination area and towards a reflective surface of said stationary reflector when said luminaire housing is installed;

said light spread lens having a first end positioned above at least a portion of said reflector lip and a second end positioned internal to said housing below said light source such that said light spread lens is disposed at an angle with respect to said light passageway, wherein a base of said reflector lip helps define a portion of said light passageway perimeter most distal the illumination area when said luminaire is installed;

said aperture reflector having a first end originating from a portion of said light passageway perimeter substantially opposite said reflector lip and a second end positioned proximal to said second end of said light spread lens such that said aperture reflector is disposed at an angle with respect to said light passageway, said stationary reflector having a contour and orientation such that a majority of light rays emitted from said light source and striking said stationary reflector are reflected toward said light spread lens.

10. The luminaire housing of claim 9 wherein a clip attaches said second end of said aperture reflector to said light spread lens proximal to said second end of said light spread lens.

11. The luminaire housing of claim 10 wherein said second end of said light spread lens is proximal to said light source.

12. The luminaire housing of claim 9 wherein said first end of said light spread lens is positioned above the entirety of said reflector lip.

13. The luminaire housing of claim 9 wherein said light source comprises at least one LED.

14. The luminaire housing of claim 13 wherein said light source comprises a plurality of multicolored LEDs.

15. The luminaire housing of claim 9 wherein said light passageway perimeter defines a rectangular light passageway.

16. The luminaire housing of claim 9 wherein said aperture reflector at least partially supports said light spread lens.

17. A wall wash LED luminaire comprising:

a housing having a plurality of color LEDs including an interior color mixing chamber, said chamber having a curved primary reflector generally opposing said plurality of LEDs and redirecting light towards an upwardly angled diffusing lens, said diffusing lens extending upward from above a lower kick reflector towards said plurality of LEDs and substantially retained within said housing;

an aperture reflector extending from a top end of said diffusing lens and generally optically opposing said kick reflector;

wherein said plurality of LEDs are directed primarily away from a vertical surface to be illuminated, said primary reflector and said kick reflector redirecting light from said LEDs substantially to said vertical surface.

* * * * *